US006182625B1

(12) United States Patent
Ozeki et al.

(10) Patent No.: US 6,182,625 B1
(45) Date of Patent: Feb. 6, 2001

(54) OIL-PASSAGE STRUCTURE OF INTERNAL COMBUSTION ENGINE

(75) Inventors: Hisashi Ozeki; Takashi Ito, both of Shizuoka-ken (JP)

(73) Assignee: Suzuki Motor Corporation, Shizuoka-ken (JP)

( * ) Notice: Under 35 U.S.C. 154(b), the term of this patent shall be extended for 0 days.

(21) Appl. No.: 09/473,889

(22) Filed: Dec. 28, 1999

(30) Foreign Application Priority Data

Dec. 29, 1998 (JP) ..... 10-377542

(51) Int. Cl.[7] ..... F01M 1/06

(52) U.S. Cl. ..... 123/90.33; 123/196 R; 123/195 C; 123/198 E; 184/6.5

(58) Field of Search ..... 123/90.31, 90.33, 123/90.34, 90.38, 195 C, 196 R, 198 R, 198 E; 184/6.5

(56) References Cited

U.S. PATENT DOCUMENTS

| | | | | |
|---|---|---|---|---|
| 5,301,639 | * | 4/1994 | Satou | 123/90.17 |
| 5,353,755 | * | 10/1994 | Matsuo et al. | 123/90.13 |
| 5,474,038 | * | 12/1995 | Golovatai-Schmidt et al. | 123/90.17 |
| 5,988,126 | * | 11/1999 | Strauss et al. | 123/90.17 |
| 6,035,817 | * | 3/2000 | Uchida | 123/90.17 |

FOREIGN PATENT DOCUMENTS

| | | |
|---|---|---|
| 62-179314 | 11/1987 | (JP) . |
| 5-6112 | 1/1993 | (JP) . |
| 5-71315 | 3/1993 | (JP) . |
| 5-288022 | 11/1993 | (JP) . |
| 6-159020 | 6/1994 | (JP) . |
| 6-212918 | 8/1994 | (JP) . |
| 6-317113 | 11/1994 | (JP) . |
| 7-166831 | 6/1995 | (JP) . |
| 8-28231 | 1/1996 | (JP) . |
| 8-100611 | 4/1996 | (JP) . |
| 8-232625 | 9/1996 | (JP) . |
| 9-170415 | 6/1997 | (JP) . |
| 9-170416 | 6/1997 | (JP) . |
| 9-222008 | 8/1997 | (JP) . |
| 9-280014 | 10/1997 | (JP) . |
| 9-317412 | 12/1997 | (JP) . |
| 10-8987 | 1/1998 | (JP) . |
| 10-8988 | 1/1998 | (JP) . |
| 10-121918 | 5/1998 | (JP) . |
| 10-184331 | 7/1998 | (JP) . |

* cited by examiner

*Primary Examiner*—Weilun Lo
(74) *Attorney, Agent, or Firm*—Flynn, Thiel, Boutell & Tanis, P.C.

(57) ABSTRACT

An oil-passage structure of an internal combustion engine which eliminates the necessity of drilling a hole through the chain cover or the tensioner bracket and allows the tensioner bracket to be moved to its proper position according to vehicle layout restrictions, and. maintains optimum functioning of the oil control valve by cooling the oil supplied thereto. The oil-passage structure includes an external oil pipe interconnecting the oil pump and the oil control valve and arranged between the auxiliaries machine driving belt and the chain cover.

11 Claims, 8 Drawing Sheets

OIL-PASSAGE STRUCTURE OF INTERNAL COMBUSTION ENGINE

FIELD OF THE INVENTION

The present invention relates to an oil-passage structure of an internal combustion engine, and more particularly to a structure that introduces oil to an oil control valve for operating hydraulic equipment.

BACKGROUND OF THE INVENTION

In an internal combustion engine of an automobile, an oil-passage structure is provided. The internal combustion engine is constructed such that a crankshaft is supported by the cylinder block and a plurality of auxiliaries or auxiliary devices are provided; a crank pulley and a crank timing sprocket are provided on the crankshaft; camshafts for opening and closing an intake valve and an exhaust valve, respectively, are supported on a cylinder head; cam sprockets are provided on the camshafts; a timing chain is wound around the crank timing sprocket and the cam sprockets; a chain cover extending over the cylinder block and the cylinder head is provided so as to cover the timing chain; a driving belt is wound around each of the auxiliaries and around the crank pulley; an oil pump to be driven by the crankshaft is provided; and an oil control valve for operating a hydraulic actuator of a variable valve timing system is provided to thereby introduce oil from the oil pump to the oil control valve.

The variable valve timing system is constructed as shown in FIG. 11: the oil pump 204 and the crank timing sprocket 206 are provided on the crankshaft 202; the intake and exhaust cam sprockets 212 and 214 are provided on the intake and exhaust camshafts 208 and 210, respectively; the timing chain 216 is wound around the crank timing sprocket 206 and the intake and exhaust cam sprockets 212 and 214; the hydraulic actuator 218 as a hydraulic unit is provided at one end of the intake camshaft 208; the oil control valve 220 for operating the hydraulic actuator 218 is provided on a cylinder head (not shown) and control means such as an electronic control unit (ECU) 222 (shown schematically) for operating the oil control valve 220 is provided. The control means 222 communicates with a crank angle sensor 224 and a cam angle sensor 226 via electrical signals (shown in dotted lines on FIG. 11) whereby the optimum valve timing is calculated according to the operating condition of the internal combustion engine. The oil pressure (depicted by the solid line in FIG. 11) supplied to the hydraulic actuator 218 is controlled by operating the oil control valve 220 to vary the phases of the intake cam shaft 208 and the crankshaft 202.

In the above case, as shown in FIG. 12, in order to introduce the oil from the oil pump 204 on the side of the cylinder block to the oil control valve 220 on the side of the cylinder head, a pipe connection 230 at one end of the oil pipe 228 is fixed to the cylinder block 234 by means of a union bolt 232 and a pipe connection 236 at the other end of the oil pipe 228 is fixed to an intake cam cap 240 (for retaining the intake camshaft 208) by means of an additional union bolt 238.

Examples of such an oil-passage structure are disclosed in Japanese Patent Laid-Open Nos. 8987/1998, 8988/1998, 170415/1997, 170416/1997 and 212918/1994. The structure described in Japanese Patent Laid-Open No. 8987/1998 is such that the entire chain cover is formed by a material different from that of the cylinder head and a portion to which the oil supply portion of the variable valve timing system is fixed is formed integrally with the chain cover, thereby improving the assembly operation. The structure described in Japanese Patent Laid-Open No. 8988/1998 is the same as that which is disclosed in Japanese Patent Laid-Open No. 8987/1998 in that first and second camshafts are provided, a variable valve timing unit is provided on the second camshaft, and the oil housing main body of the second camshaft is arranged outside with respect to the primary sprocket of the first camshaft to thereby make the structure compact. Further, the structure described in Japanese Patent Laid-Open No. 170416/1997 is the same as that which is disclosed in Japanese Patent Laid-Open No. 170415/1998 in that a controlling oil passage and a lubricating oil passage are arranged forward and rearward, respectively, across the engine thereby making the structure compact. Lastly, the structure described in Japanese Patent Laid-Open No. 212918/1994 is such that in the case of the variable valve timing system of a V-type engine, an operating oil pressure path connecting an oil pressure control valve and a variable control mechanism is provided by making use of the space between the right and left banks of the engine.

Now, in the case of the conventional internal combustion engine provided with a variable valve timing unit, an oil passage is formed in the chain cover so as to establish an oil passage system for introducing oil from the main gallery formed in the cylinder block to the oil control valve and an oil passage communicating with the above-described oil passage is formed by drilling a hole through the tensioner bracket, whereby the belt tensioner and the tensioner bracket are arranged close to the cylinder block. However, the formation of the oil passage by drilling a hole through the tensioner bracket has created difficulties or inconveniences in that in situations where the tensioner bracket is required to be moved due to restrictions in the layout for each vehicle type, the tensioner bracket cannot be arranged at the proper position. Thus the number of processing steps increases which results in increases in the equipment and processing costs. Further, the temperature of the oil increases due to the heat of the internal combustion engine which has a negative effect on the functioning of the oil control valve.

In addition, in the case where an oil pipe is arranged outside the belt tensioner so as to overlap the latter for the purpose of establishing an oil passage system which introduces oil from the main gallery formed in the cylinder block to the oil control valve, there have hitherto been such inconveniences that when the internal combustion engine is mounted in the vehicle body, the oil pipe tends to come into contact with the vehicle body resulting in possible damage to the oil pipe. Further, since the oil pipe is arranged astride the driving belt for the auxiliaries, when the belt is replaced, it becomes necessary to remove the oil pipe thereby increasing service time.

Therefore, in order to eliminate or at least minimize the above-described inconveniences, the present invention includes: an oil-passage structure of an internal combustion engine having a cylinder block provided with a plurality of auxiliaries or auxiliary devices; a crankshaft provided with a crank pulley and a crank timing sprocket and supported by the cylinder block; a cylinder head positioned on the cylinder block; camshafts supported by the cylinder head for opening and closing intake valve and exhaust valves; cam sprockets attached to the camshafts; a timing chain wound around the crank timing sprocket and the cam sprocket; a chain cover extending over the cylinder block and the cylinder head so as to cover the timing chain; a driving belt wound around pulleys for a plurality of auxiliaries and around the crank pulley; an oil pump to be driven by the crankshaft; an oil control valve for operating hydraulic equipment whereby oil from the oil pump is introduced to the oil control valve; and an external oil pipe connecting the oil pump and the oil control valve and arranged between the auxiliaries driving belt and the chain cover.

According to the present invention, since an external oil pipe is provided between the auxiliaries driving belt and the chain cover so as to connect the oil pump and the oil control valve, it is no longer necessary to drill an oil passage hole in the tensioner bracket as has conventionally been necessary, and the tensioner bracket can be moved to a proper position when necessary due to restrictions in layout for each vehicle type. Further, it is also possible to reduce equipment processing costs by reducing the number of processing steps, and it is also possible to maintain proper functioning of the oil control valve by cooling the oil supplied to the oil control valve.

Further, since the oil pipe does not project outwardly, the oil pipe does not come into contact with the body of the vehicle at the time of mounting the internal combustion engine, thereby preventing possible damage to the oil pipe. Further, when the auxiliaries driving belt is replaced, it is not necessary to remove the oil pipe thereby improving serviceability.

DETAILED DESCRIPTION

Figure 1:
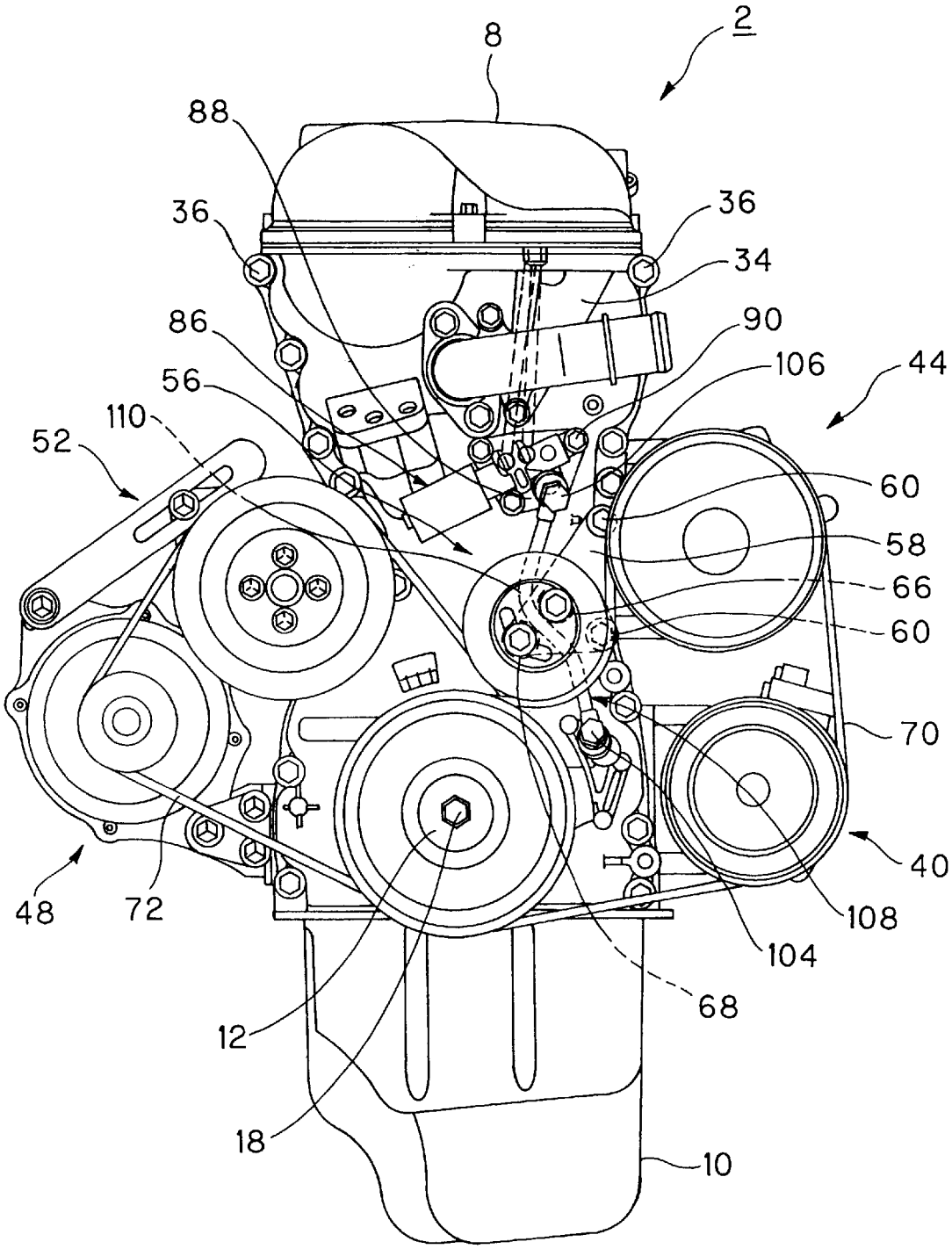
FIG. 1 is a front view of an internal combustion engine according to a first embodiment of the invention.

FIGS. 1 through 9 show a first embodiment of the invention. In FIGS. 1 through 4, reference numeral 2 designates a multiple cylinder internal combustion engine to be mounted on a vehicle (not shown), 4 designates a cylinder block, 6 designates a cylinder head, 8 designates a cylinder head cover and 10 designates an oil pan.

In the cylinder block 4 there is supported a crankshaft 12 which mounts thereon first and second crank pulleys 14 and 16 by means of a pulley fitting bolt 18 which also secures crank timing sprocket 20.

On the upper portion of the cylinder head 6, an intake cam shaft 22 and an exhaust cam shaft 24 are supported in parallel relationship with each other. Further, an intake cam sprocket 26 is fixed to the intake cam shaft 22, and an exhaust cam sprocket 28 is mounted to the exhaust cam shaft 24. A timing chain 30 is wound around the crank timing sprocket 20, the intake cam sprocket 26 and the exhaust cam sprocket 28.

A chain cover 34 for covering timing chain 30 is attached to the cylinder block 4 and the cylinder head 6 by means of a plurality of cover fixing bolts 36 so as to form a chain chamber 32. The chain cover 34 is made of aluminum, for example.

Further, an air compressor 40 provided with an air compressor pulley 38, a power steering pump 44 provided with a power steering pump pulley 42, an alternator 48 provided with an alternator pulley 46, and a water pump 52 provided with a water pump pulley 50 are all attached to the cylinder block 4. Further, also attached to the cylinder block 4 are a belt tensioner 56 provided with a tensioner pulley 54 at a position adjacent the first and second crank pulleys 14, 16, the power steering pulley 42 and water pump pulley 50.

The belt tensioner 56 is attached to the chain cover 34 through a tensioner bracket 58 by fixing bolts 60. The tensioner bracket 58 is provided with a pulley supporting bolt 62 serving as a fulcrum and a pulley fixing bolt 64. Tensioner bracket 58 is also provided on its surface on the side facing the chain cover 34 with a first bolt back-boss 66 and a second bolt back-boss 68 which respectively correspond to the above-described bolts 62 and 64, respectively.

A first auxiliaries driving belt 70 is wound around the first crank pulley 14, the air compressor pulley 38, the tensioner pulley 54 and the power steering pump pulley 42. Further, a second auxiliaries driving belt 72 is wound around the second crank pulley 16, the alternator pulley 46 and the water pump pulley 50.

The crankshaft 16 has an oil pump 74 attached thereto at a position near the crank timing sprocket 20. The oil pump 74 is provided with a rotor chamber 76 which is formed by a portion of the chain cover 34 on the side of the cylinder block 4 and the pump plate (not shown), and an oil discharge port 78. Within the rotor chamber 76 there is disposed a pump rotor (not shown) which is mounted on the crankshaft 12.

A hydraulic actuator 82 of a hydraulic unit (i.e. a variable valve timing unit 80) is attached to the intake camshaft 22.

A valve body 88 of an oil control valve 86 is provided on the chain cover 34. Valve body 88 is fixed to a valve fixing boss 84 of cover 34 at the same level as the cylinder head 6 by means of a valve fixing bolt 90. The oil control valve 86 is operated by control means (not shown) which is adapted to adjust the valve timing by controlling the oil pressure to the hydraulic actuator 82.

Figure 8:
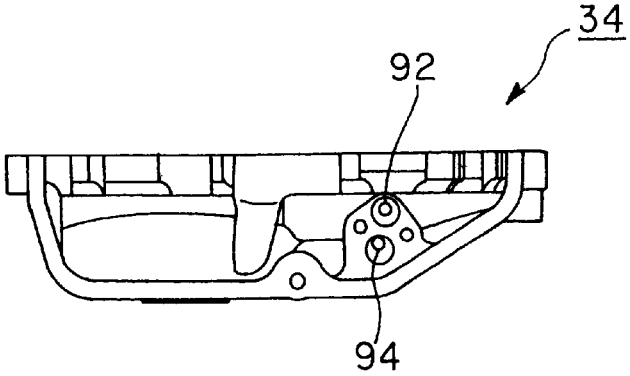
FIG. 8 is a plan view of the chain cover.
Figure 9:
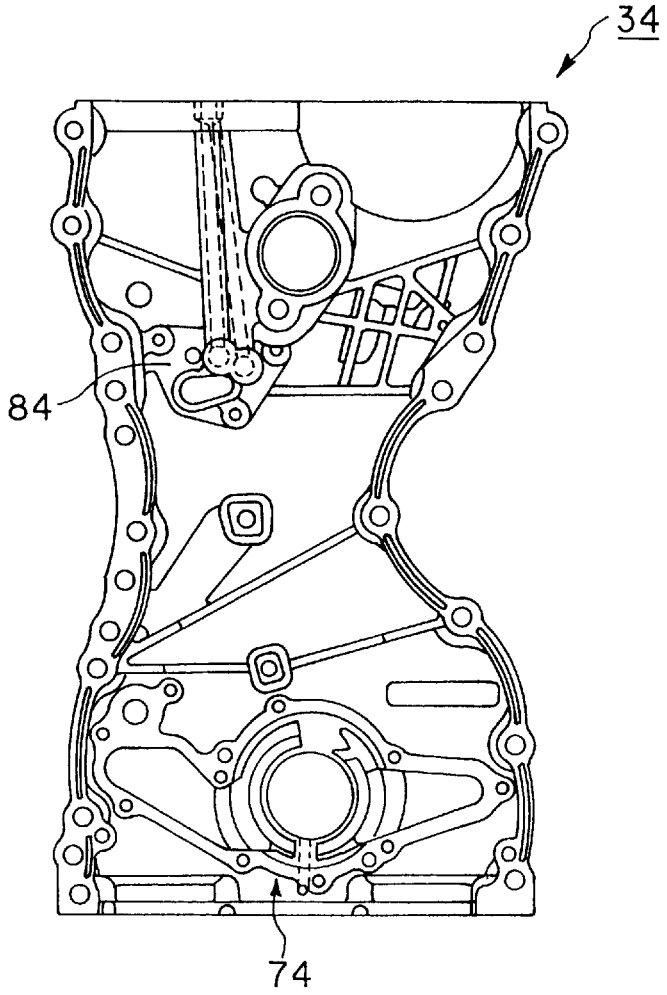
FIG. 9 is a rear view of the chain cover.

Further, as shown in FIG. 8, an advance-angle side oil passage 92 and a lag-angle side oil passage 94 are provided in the chain cover 34. The advance-angle side oil passage 92 is connected with an advance-angle side pipe 96 which communicates with the hydraulic actuator 82, and the lag-angle side oil passage 94 is connected with a lag-angle side pipe 98 which communicates with the hydraulic actuator 82.

Figure 2:
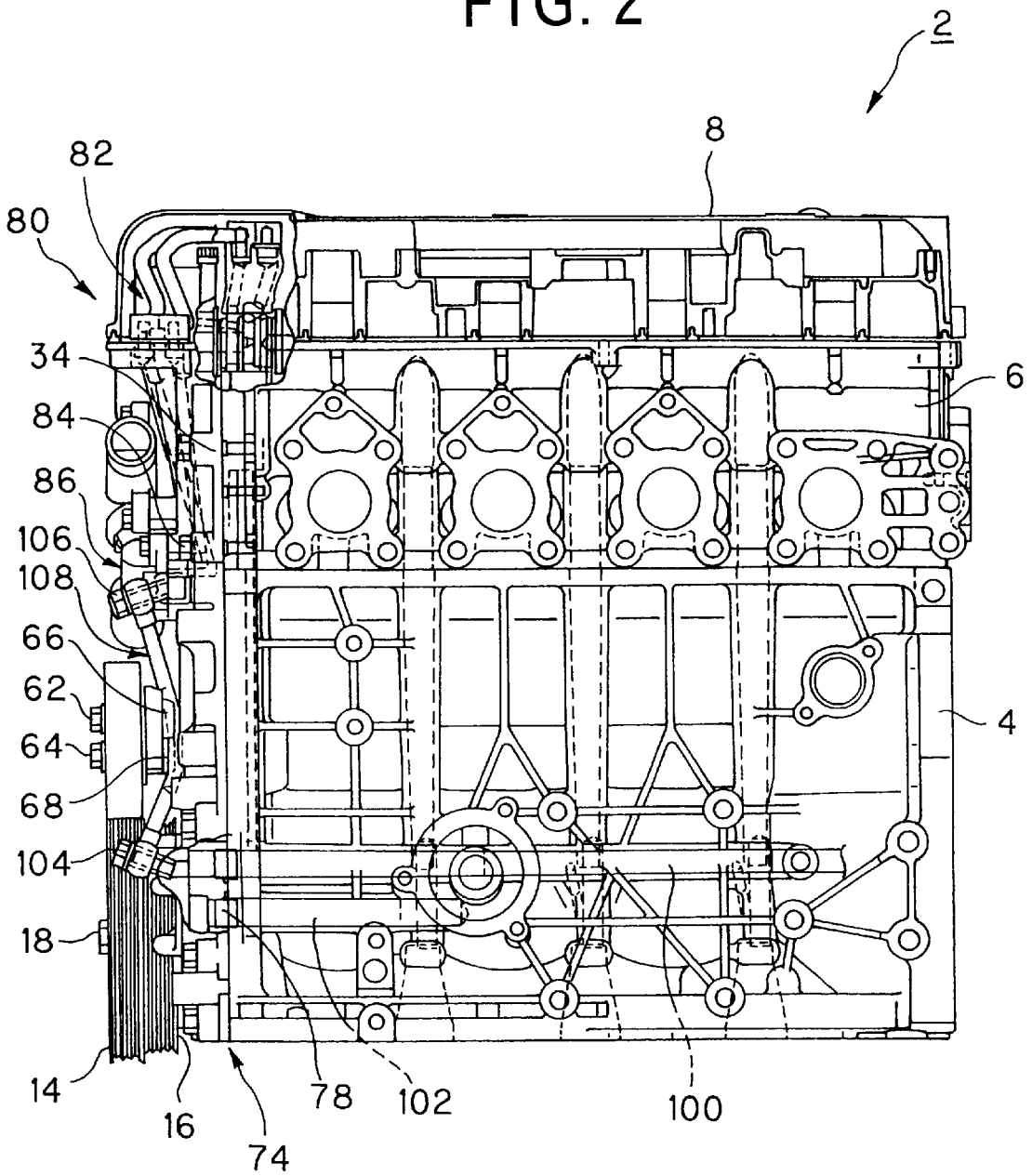
FIG. 2 is a cross-sectional view of the internal combustion engine of FIG. 1.
Figure 3:
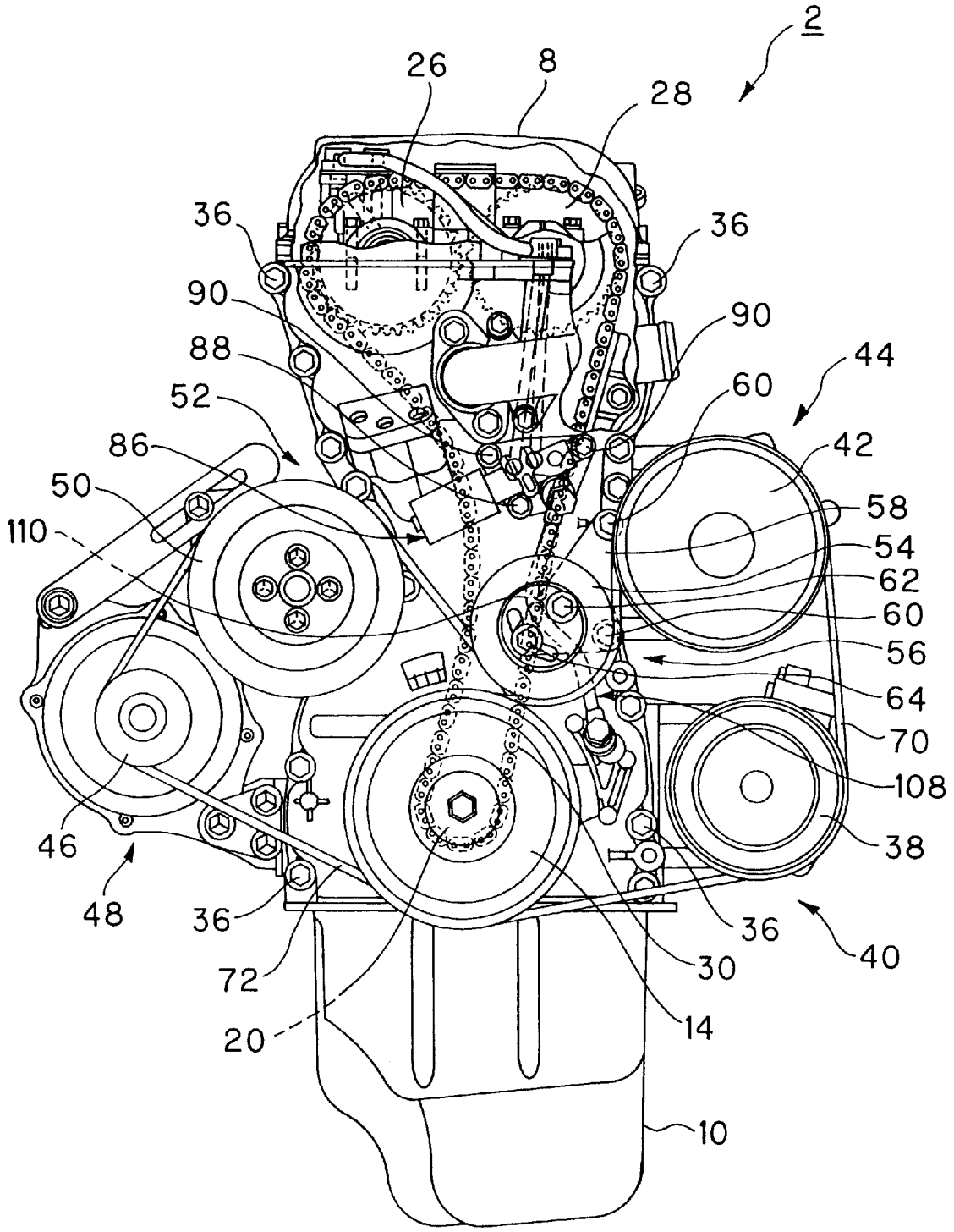
FIG. 3 is a schematic front view of the internal combustion engine.
Figure 4:
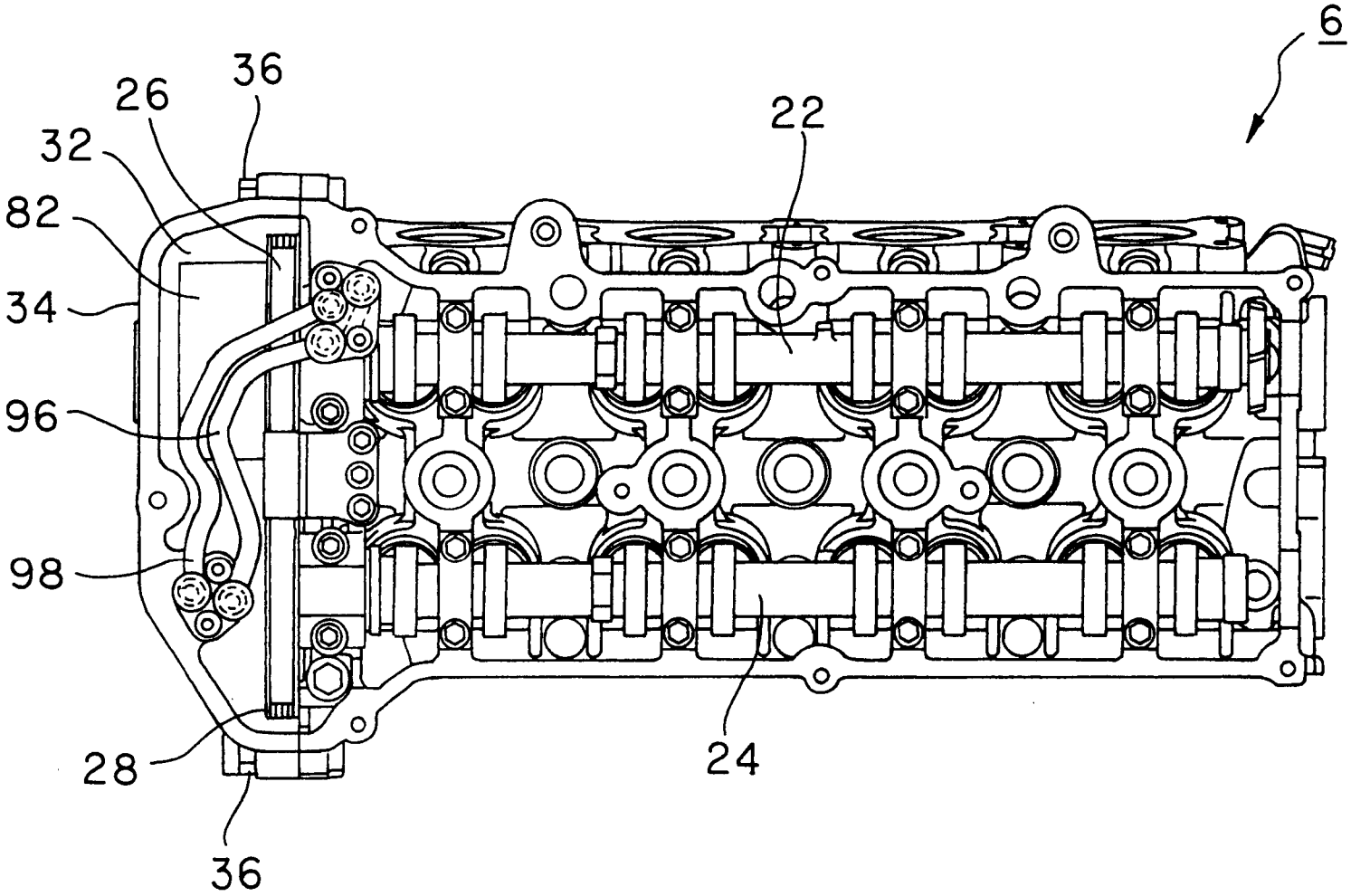
FIG. 4 is a plan view of a cylinder head.
Figure 5:
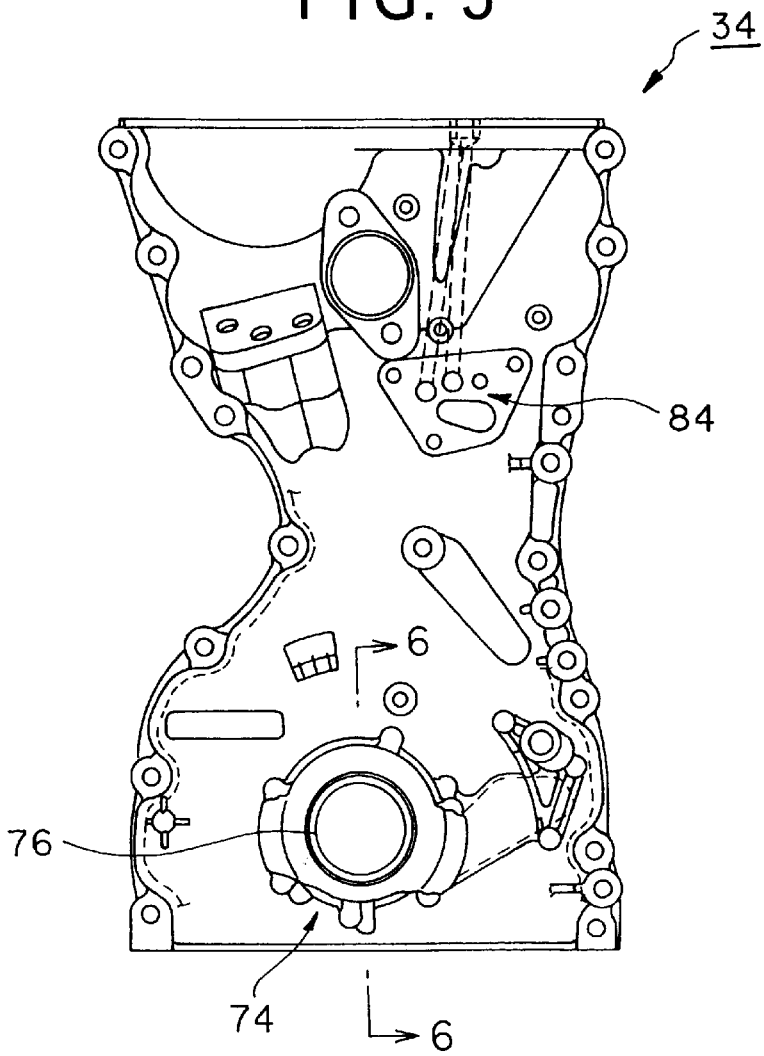
FIG. 5 is a front view of a chain cover.
Figure 6:
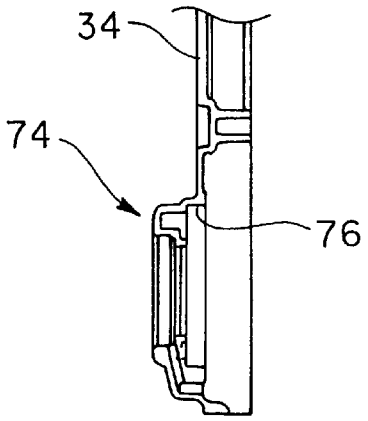
FIG. 6 is an enlarged fragmentary, cross-sectional view taken generally along line 5—5 in FIG. 5.
Figure 7:
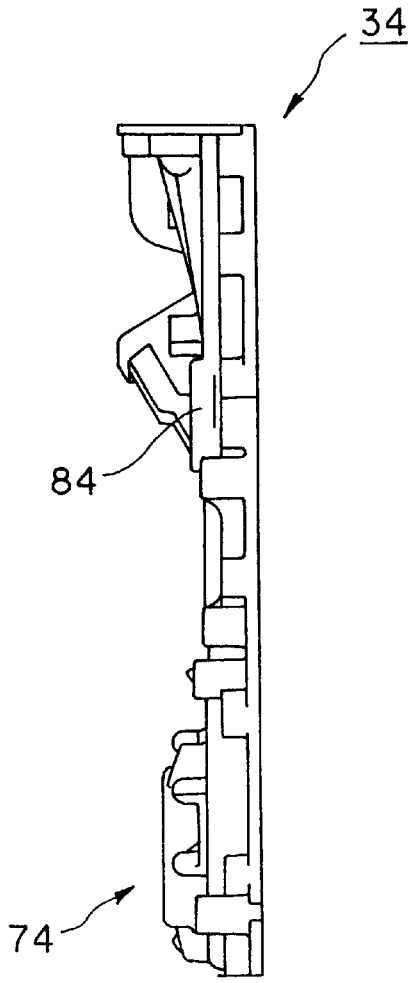
FIG. 7 is a side view of the chain cover.

As shown in FIG. 2, a main oil gallery 100 and a sub-gallery 102 are formed in the cylinder block 4 in the direction of the axis of the crankshaft 12.

A first union bolt 104 leading to the main gallery 100 is attached to the chain cover 34. Further, a second union bolt 106 is directly fixed to the valve body 88 of the oil control valve 86.

The first and second union bolts 104 and 106 are connected with an external oil pipe 108 so as to connect the oil pump 74 and the oil control valve 86 together. Consequently, the oil pipe 108 is directly attached to the valve body 88. The oil pipe 108 is made of a ferrous material, for example. Further, oil pipe 108 has a coefficient of thermal expansion different from that of the chain cover 34 and is arranged adjacent the chain cover 34 and the first auxiliaries driving belt 70 and belt tensioner 56.

In the illustrated embodiment, the union bolts 104 and 106 each include a generally radially extending passage so as to enable communication with pipe 108, and an axially extending passage which communicates with the respective radial passage. The axial passage of bolt 104 additionally communicates with main gallery 100, and the axial passage of bolt 106 additionally communicates with oil control valve 86.

Further, in this first embodiment, the oil pipe 108 is arranged behind the tensioner bracket 58 adjacent the front face of the chain cover 34, and within the first auxiliaries driving belt 70, and extends between the first and second bolt back-bosses 66 and 68 (as shown in dotted lines in FIG. 1).

The oil pipe 108 includes a pre-bent portion 110 so as not to interfere with other engine parts while absorbing the difference in the coefficients of thermal expansion between the pipe 108 and the chain cover 34. Further, oil pipe 108 is arranged at a position at which it is subjected to a moving air flow which serves to cool pipe 108.

Next, the operation of the oil-passage structure according to the first embodiment will be described.

When the oil pump 74 is driven, the oil in the oil pan 10 is sent from the main gallery 100 to the oil pipe 108 until it reaches the oil control valve 86.

The oil control valve 86 is operated by a control means (not shown) based upon various conditions such as engine r.p.m., the degree of opening of the accelerator, the engine coolant temperatures, etc., to operate the hydraulic actuator 82 by adjusting the oil pressure to the advance-angle side .pipe 96 and the lag-angle side pipe 98 to thereby enable proper valve timing.

According to this first embodiment, the oil pipe 108 is of the outside-fitting type and is arranged among or adjacent the chain cover 34, the first auxiliaries driving belt 70 and the belt tensioner 56, and also between the first and second bolt back-bosses 66, 68 so that when it is desirable to change the position of the belt tensioner bracket 58, it is only necessary to change the shape of the oil pipe 108. Thus, it becomes possible to change the position of the belt tensioner 56 for each type of vehicle without changing the belt line.

Further, since the oil pipe 108 is located on the rear side of the belt tensioner 56, when the internal combustion engine 2 is mounted, the oil pipe 108 is protected by the belt tensioner 56 to thereby avoid damage to the oil pipe 108.

Still further, since the oil pipe 108 is located between the first bolt back-boss 66 and the second bolt back-boss 68, the belt tensioner 56 can be positioned as close as possible to the cylinder block 4 which reduces the length of the engine 2 and enables easier mounting of same in a vehicle.

Also, due to the fact that the oil pipe 108 can be directly mounted on the valve body 88, the process of forming a hole for an oil passage through the chain cover 34 or the belt tensioner bracket 58 is no longer required, and so it is possible to reduce the equipment and labor costs which thereby reduces manufacturing cost.

Further, the oil pipe 108 is made to have a bent portion 110 which takes into consideration the difference between the coefficients of thermal expansion between the oil pipe 108 and the chain cover 34, and for the purpose of preventing interference with the remaining engine parts. Therefore, the oil pipe 108 does not interfere with the other parts adjacent thereto, and since the oil in the oil pipe 108 is cooled by a cool and moving air flow, optimal functioning of the oil control valve 86 can be maintained thereby improving the performance of the hydraulic actuator 82.

Still further, since the oil pipe 108 does not project outward, when the internal combustion engine 2 is mounted in the vehicle, the oil pipe 108 does not come into contact with the body of the vehicle thereby preventing damage to the oil pipe 108. Further, when the first and second auxiliaries driving belts 70 and 72 are replaced, it is not necessary to remove the oil pipe 108 thereby improving the serviceability.

Figure 10:
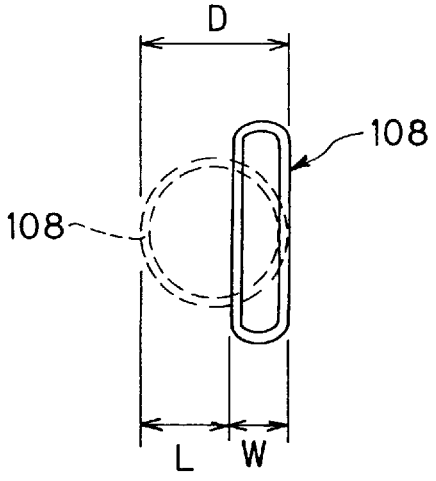
FIG. 10 is a cross-sectional view of an oil pipe according to a second embodiment of the present invention.
Figure 11:
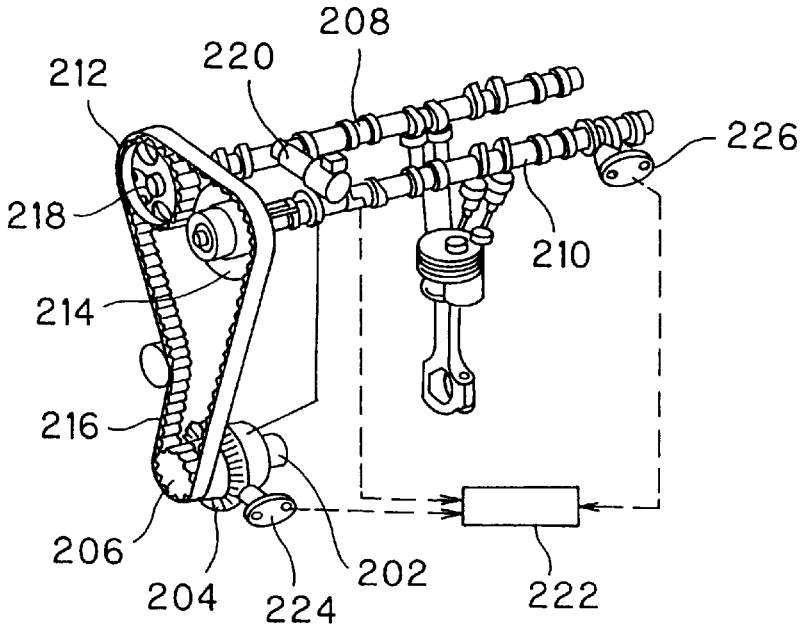
FIG. 11 PRIOR ART
FIG. 11 is a schematic diagram of a conventional variable valve timing system.
Figure 12:
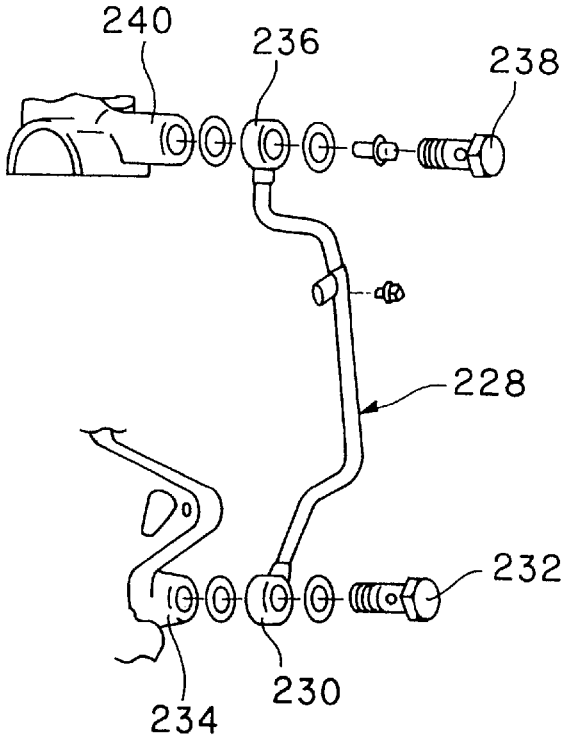
FIG. 12 PRIOR ART
FIG. 12 is a schematic exploded diagram illustrating a conventional mounting of an external oil pipe.

FIG. 10 shows a second embodiment of the invention.

In this second embodiment, parts similar to or the same as parts included in the first embodiment are designated by the same reference numerals.

The characteristics of the second embodiment reside in the following points. That is, the oil pipe 108 has a width W which is smaller than the diameter D thereof at the belt tensioner 56 (FIG. 3), while keeping a required cross-sectional flow area of the oil pipe passage.

According to the second embodiment of the present invention, the oil pipe 108 is made narrower or is partially flattened by the length or amount L at the position of the belt tensioner 56 and is disposed behind the belt tensioner bracket adjacent the front face of the chain cover whereby the belt tensioner 56 can be positioned closer to the cylinder block 4 thereby making the internal combustion engine 2 more compact. In this regard, the flattened part of oil pipe 108 can be positioned between tensioner bracket 58 and chain cover 34, and for example can be positioned so as to extend between the bosses 66 and 68.

As is clear from the detailed description of the invention, the external oil pipe which interconnects the oil pump and the oil control valve is arranged between the auxiliaries driving belt and the chain cover and, as a result, the drilling of a hole through the chain cover or the tensioner bracket is no longer required so that the tensioner bracket can be moved to its proper position subject to the layout restrictions for each vehicle type; and the equipment cost and the processing cost can be reduced by reducing the number of processing steps; and the function of the oil control valve can be maintained in a favorable condition by cooling the oil supplied to the oil control valve.

Further, since the oil pipe does not project outwardly, the oil pipe does not come into contact with the body of the vehicle at the time of mounting the internal combustion engine which can prevent damage to the oil pipe. Further, when the auxiliaries driving belt is replaced, it is not necessary to remove the oil pipe thereby improving the serviceability.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil-passage structure of an internal combustion engine including a cylinder block, a plurality of auxiliaries having pulleys associated therewith, a crankshaft provided with a crank pulley and a crank timing sprocket and supported on the cylinder block, a cylinder head positioned on the cylinder block, intake and exhaust camshafts supported by the cylinder head for opening and closing an intake valve and an exhaust valve respectively, cam sprockets respectively attached to the intake and exhaust camshafts, a timing chain wound around the crank timing sprocket and the cam sprockets, a chain cover extending over the cylinder block and the cylinder head so as to cover the timing chain, an auxiliaries driving belt wound around the pulleys associated with the auxiliaries and around the crank pulley, an oil pump to be driven by the crankshaft, an oil control valve for operating hydraulic equipment whereby oil from the oil pump is introduced to the oil control valve, and an external oil pipe connecting the oil pump and the oil control valve, the external oil pipe being positioned between the auxiliaries driving belt and the chain cover.

2. An oil-passage structure of an internal combustion engine including a cylinder block provided with a plurality of auxiliaries having pulleys associated therewith, a crankshaft provided with a crank pulley and a crank timing sprocket and supported on the cylinder block, a cylinder head positioned on the cylinder block, intake and exhaust camshafts supported by the cylinder head for opening and closing an intake valve and an exhaust valve respectively, cam sprockets respectively attached to the intake and exhaust camshafts, a timing chain wound around the crank timing sprocket and the cam sprockets, a chain cover extending over the cylinder block and the cylinder head so as to cover the timing chain, an auxiliaries driving belt wound around the pulleys associated with the auxiliaries and around the crank pulley, an oil pump to be driven by the crankshaft, an oil control valve for operating hydraulic equipment whereby oil from the oil pump is introduced to the oil control valve, a belt tensioner for adjusting the tensile force of the auxiliaries driving belt, the belt tensioner being mounted on the chain cover by a tensioner bracket, and an external oil pipe interconnecting the oil pump and the oil control valve and arranged between the tensioner bracket and the chain cover.

3. The oil-passage structure as claimed in claim 2, wherein a part of said oil pipe as disposed between said tensioner bracket and said chain cover is positioned between a pair of rearwardly protruding bosses provided on said tensioner bracket.

4. The oil-passage structure as claimed in claim 1, wherein said oil pipe is directly attached to a body of said oil control valve.

5. The oil-passage structure as claimed in claim 1, wherein said oil pipe is provided at a position in the path of a cooling air flow past the engine.

6. The oil-passage structure as claimed in claim 1, wherein said oil pipe is made of a material having a coefficient of thermal expansion which is different from that of said chain cover and is provided with a bent portion so as to avoid interference with other engine components while absorbing the difference in the coefficients of thermal expansion between it and said chain cover.

7. The oil-passage structure as claimed in claim 2, wherein the part of said oil pipe has a flattened portion adjacent said tensioner bracket, an inner passage at said flattened portion having a cross-sectional flow area substantially equal to the cross-sectional flow area of the remainder of said oil pipe.

8. The oil-passage structure as claimed in claim 2, wherein one end of said oil pipe is connected to a valve body of said oil control valve and an opposite end of said oil pipe is connected to said chain cover adjacent said oil pump.

9. The oil-passage structure as claimed in claim is 2, wherein said belt tensioner includes a pulley mounted on said tensioner bracket via first and second bolts respectively received in first and second bosses formed on a rear side of said tensioner bracket adjacent said chain cover, said oil pipe having an upper end connected to said oil control valve, a lower end connected to said chain cover and an intermediate portion disposed between said upper and lower ends, said intermediate portion being positioned between said first and second bosses at said rear side of said tensioner bracket.

10. The oil-passage structure as claimed in claim 2, wherein said chain cover cooperates with the cylinder head and cylinder block for enclosing the timing chain and the sprockets engaged therewith, the pulleys being positioned exteriorly of said chain cover in adjacent relation thereto, and said oil pipe being positioned closely adjacent an exterior face of said chain cover generally between said chain cover and said driving belt.

11. The oil-passage structure as claimed in claim 1, wherein said chain cover cooperates with the cylinder head and cylinder block for enclosing the timing chain and the sprockets engaged therewith, the pulleys being positioned exteriorly of said chain cover in adjacent relation thereto, and said oil pipe being positioned closely adjacent an exterior face of said chain cover generally between said chain cover and said driving belt.

* * * * *